US009918573B2

(12) United States Patent
Loshuk

(10) Patent No.: US 9,918,573 B2
(45) Date of Patent: Mar. 20, 2018

(54) BEVERAGE GARNISH HOLDER

(71) Applicant: Mark A. Loshuk, Fort Lauderdale, FL (US)

(72) Inventor: Mark A. Loshuk, Fort Lauderdale, FL (US)

(73) Assignee: Mark Loshuk

( * ) Notice: Subject to any disclaimer, the term of this patent is extended or adjusted under 35 U.S.C. 154(b) by 0 days.

(21) Appl. No.: 15/042,142

(22) Filed: Feb. 11, 2016

(65) Prior Publication Data

US 2017/0007049 A1 Jan. 12, 2017

Related U.S. Application Data

(60) Provisional application No. 62/189,700, filed on Jul. 7, 2015.

(51) Int. Cl.
*A47G 19/20* (2006.01)
*A47G 19/22* (2006.01)
*A47G 19/06* (2006.01)

(52) U.S. Cl.
CPC ..... *A47G 19/22* (2013.01); *A47G 19/06* (2013.01)

(58) Field of Classification Search
CPC ..... A47G 19/2227
USPC ..... 220/23.4
See application file for complete search history.

(56) References Cited

U.S. PATENT DOCUMENTS 7,980,406 B2 * 7/2011 Liu ..... B65D 67/02 220/23.2
2007/0205199 A1 * 9/2007 Wothers ..... A47G 19/22 220/506
2008/0290089 A1 * 11/2008 Ciarrocchi, Jr. ..... B65D 25/20 220/23.4
2012/0312709 A1 * 12/2012 Kaufman ..... B65D 75/5822 206/370

OTHER PUBLICATIONS

Brachiopod Morphology, http://paleo.cortland.edu/tutorial/Brachiopods/brachmorph.htm, downloaded Jul. 18, 2017, pp. 1-6.*

* cited by examiner

*Primary Examiner* — Stephen Castellano

(57) ABSTRACT

The invention is a beverage garnish holder for placement on the rim of a beverage glass and comprises: a bispherical cradle for supporting the beverage garnish; a rim incurvation configured to engage the beverage glass rim; a transition neck connecting the rim incurvation to the bispherical cradle; and a depending tab configured to extend from the rim incurvation into the beverage glass.

13 Claims, 5 Drawing Sheets

BEVERAGE GARNISH HOLDER

CROSS REFERENCE TO RELATED APPLICATION

The present Application is related to Provisional Patent Application entitled "Beverage Garnish Clip," filed 7 Jul. 2015 and assigned filing Ser. No. 62/189,700, incorporated herein by reference in its entirety.

FIELD OF THE INVENTION

The present invention relates to a device for supporting a garnish at the rim of a beverage glass.

BACKGROUND OF THE INVENTION

Adult beverages and cocktail drinks often include garnishes, such as a lemon wedge, a cherry, an olive, or a pearl onion, depending on the drink recipe. The bartender mixing the drink may typically be in view of the customer. It may upset the customer to observe the bartender or waiter using possibly soiled fingers to pluck a beverage garnish from a bowl and place it into the customer's drink, or onto the rim of the glass, even if it is appreciated that the bartender/waiter may be having a busy night and needs to work quickly. However, expecting a customer to serve himself from a garnish bowl may not be a better alternative method of garnishing a drink.

What is needed is a method of keeping a beverage garnish, such as a lemon, out of a diner's water or iced tea, when the diner is patronizing a bar or a restaurant. Placement of the garnish into the beverage may then be done by the customer.

BRIEF SUMMARY OF THE INVENTION

In one aspect of the present invention, a beverage garnish holder for placement on the rim of a beverage glass comprises: a concavo-convex cradle for supporting the beverage garnish; a rim incurvation configured to engage the beverage glass rim; a transition neck connecting the rim incurvation to the concavo-convex cradle; and a depending tab configured to extend from the rim incurvation into the beverage glass.

The additional features and advantage of the disclosed invention is set forth in the detailed description which follows, and will be apparent to those skilled in the art from the description or recognized by practicing the invention as described, together with the claims and appended drawings.

BRIEF DESCRIPTIONS OF THE DRAWINGS

The foregoing aspects, uses, and advantages of the present invention will be more fully appreciated as the same becomes better understood from the following detailed description of the present invention when viewed in conjunction with the accompanying figures, in which.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention.

The present invention relates generally to a garnish holder with a rim clip specifically configured for supportive attachment onto the rim of substantially any commercially-used beverage glass. A cocktail garnish such as a lemon wedge, for example, can be provided to a customer in the beverage garnish holder. When the garnish and the garnish holder is thus provided with the beverage glass, the customer can easily use the garnish from the holder instead of having to reach for the garnish from a garnish bowl, an action which would typically be done with unwashed customer fingers. Use of the drink garnish holder also avoids the need for a drink server to place the lemon, or lime, directly onto the rim of the beverage glass, using possibly dirty hands, which is a common sight in every public restaurant and bar.

As can be appreciated by one skilled in the art, the beverage garnish holder is configured in conformance with a specified size, angle, and bend to assure proper fit onto beverage glasses used for drinking or cocktails. In an exemplary embodiment, the beverage garnish holder may be sized and shaped to hold a lemon or lime wedge, or two cherries, or two olives, and the size of the beverage garnish holder may be scaled for attachment to other types of glass rims, such as a beer mug for example.

Figure 1:
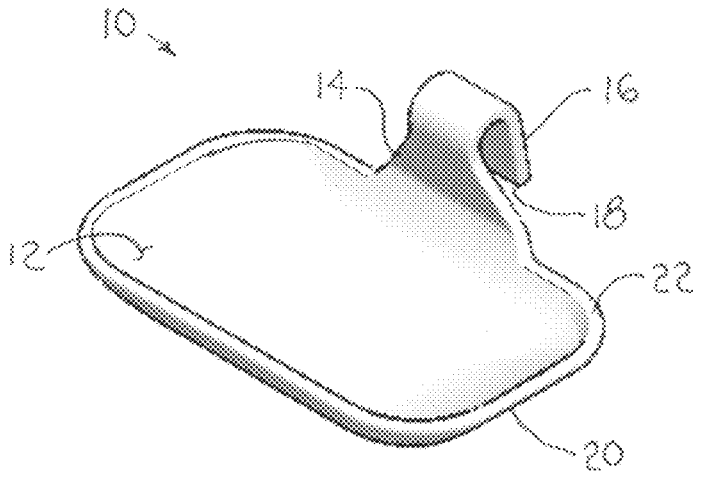
FIG. 1 is an isometric illustration of a beverage garnish holder comprising a concavo-convex cradle, a transition neck, a rim incurvation, and a depending tab in accordance with an embodiment of the present invention.

There is shown in FIG. 1 a beverage garnish holder 10 suitable for use with a garnish or condiment, as described above. The beverage garnish holder 10 includes a concavo-convex cradle 20, a transition neck 14, a rim incurvation 32, and a depending tab 16. The concavo-convex cradle 20 functions to hold the beverage condiment or garnish. The depending tab 16 defines a slot 18 under the rim incurvation 32 which functions to engage the beverage garnish holder 10 with the rim of the beverage glass (shown in FIG. 6). The transition neck 14 functions to position the concavo-convex cradle 20 at a predetermined distance below the rim of the beverage glass. As can be seen in the illustration, the concavo-convex cradle 20 has a generally concave upper surface 12 bordered by a cradle rim 22, where the width of the cradle rim 22 is slightly greater than the thickness of a plastic, glass, or metallic material forming the concavo-convex cradle 20.

Figure 2:
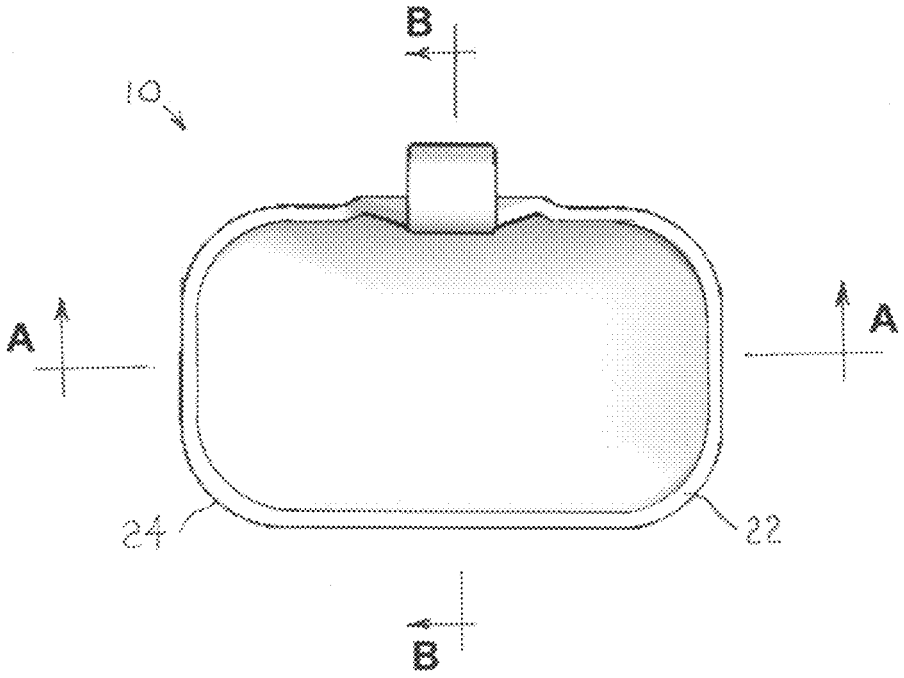
FIG. 2 is a top view of the beverage garnish holder of FIG. 1.

As seen in FIG. 2, concavo-convex cradle 20 may be generally rectangular in shape, with rounded corners 24. The cradle rim 22 may comprise a flat planar edge surface or, in alternative embodiments, the generally rectangular cradle rim 22 may have a rounded surface edge or other non-planar surface edge (shown in FIG. 8 below) to provide a decorative appearance to the beverage garnish holder 10.

Figure 3:
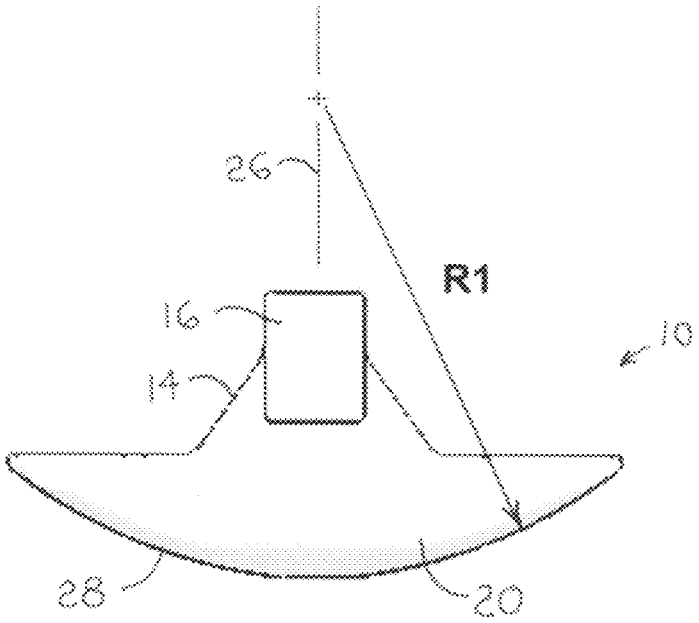
FIG. 3 is a rear view of the beverage garnish holder of FIG. 1.

FIG. 3 shows the beverage garnish holder 10 from the beverage glass rim side. As can be seen from the illustration, the beverage garnish holder 10 has a plane of symmetry 26 passing through the concavo-convex cradle 20, the transition neck 14 the rim incurvation 32, and the depending tab 16. In the illustration shown, the transition neck 14 has a substantially isosceles trapezoid shape, and the depending tab 16 is substantially rectangular in shape. A convex bottom surface 28 of the concavo-convex cradle 20 has a radius of R1, as viewed from the back side of the garnish holder 10. In an exemplary embodiment, the dimension R1 can be from approximately 40 mm to about 50 mm, and nominally, about 44.6 mm.

Figure 4:
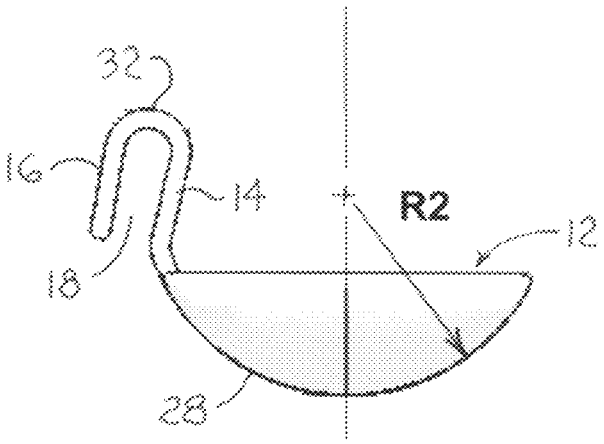
FIG. 4 is a side view of the beverage garnish holder of FIG. 1.

FIG. 4 shows a side view of the garnish holder 10. The convex bottom surface 28 of the concavo-convex cradle 20, as seen from this direction, has a radius of 'R2.' In an exemplary embodiment, the dimension R2 can be from about 15 mm to approximately 20 mm, and nominally, about 16.8 mm. Accordingly, the bottom surface 28 of the concavo-convex cradle 20 does not comprise a simply spherical shape with a constant spherical radius of curvature when viewed from front, rear, or side. The novel cradle 20 is herein described as "concavo-convex," having one surface radius, a major radius, of curvature 'R1' as viewed from one direction, that is, the from the front or rear direction, and as having another surface radius, a minor radius, of curvature 'R2' as viewed from a second direction orthogonal to the first direction, that is, from either side. The concavo-convex cradle 20 thus functions to physically retain a round or oval garnish, such as a pearl onion, in the concave upper surface 12 and keep the round or oval garnish from falling out of the beverage garnish holder 10. As best seen in this illustration, the slot 18 extends to a rim incurvation 32 connecting the depending tab 16 to the transition neck 14.

Figure 5:
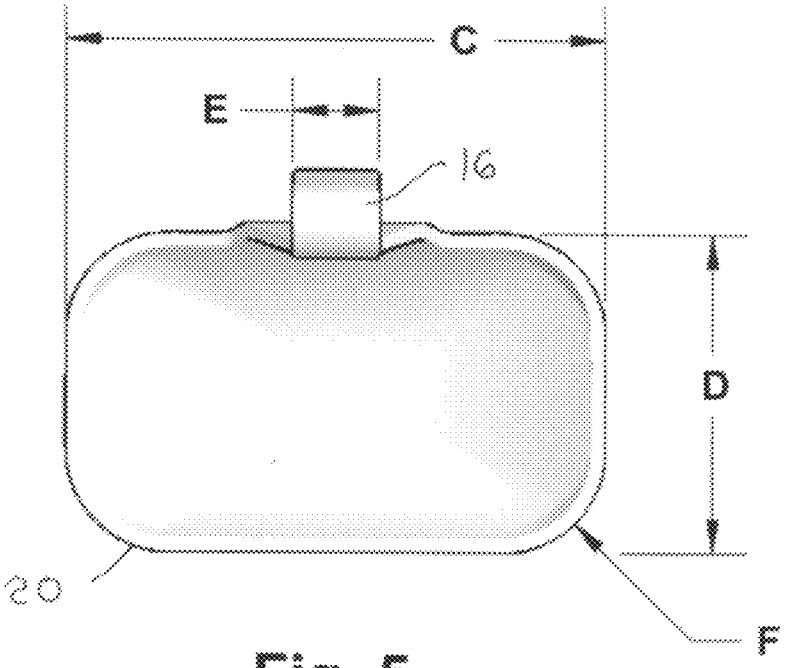
FIG. 5 is a top view of the beverage garnish holder of FIG. 1.
Figure 6:
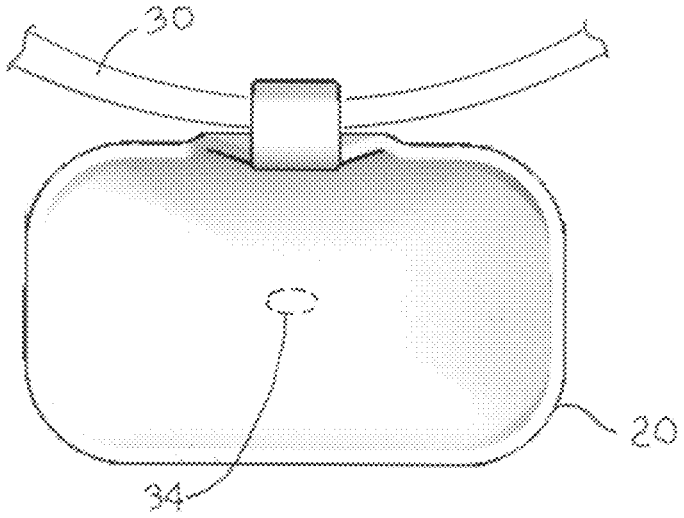
FIG. 6 is a top view of the beverage garnish holder of FIG. 1 mounted on a beverage glass rim and showing an optional cradle opening for drainage.

FIG. 5 shows a top view of the garnish holder 10 with exemplary dimensions. The length 'C' of the concavo-convex cradle 20 may be approximately 50 mm, with a width 'D' of approximately 30 mm. The width 'E' of the depending tab 16 may be about 8 mm. The corners of the concavo-convex cradle 20 may have a radius 'F' of about 9.5 mm. FIG. 6 shows that, in an exemplary embodiment, the garnish holder 10 may include an optional cradle opening 34 centrally located in the concavo-convex cradle 20 to prevent the accumulation of liquid from the beverage garnish by draining off fluid. A portion of the rim 30 of a beverage glass is shown to illustrate the placement of the garnish holder 10 on the beverage glass.

Figure 7:
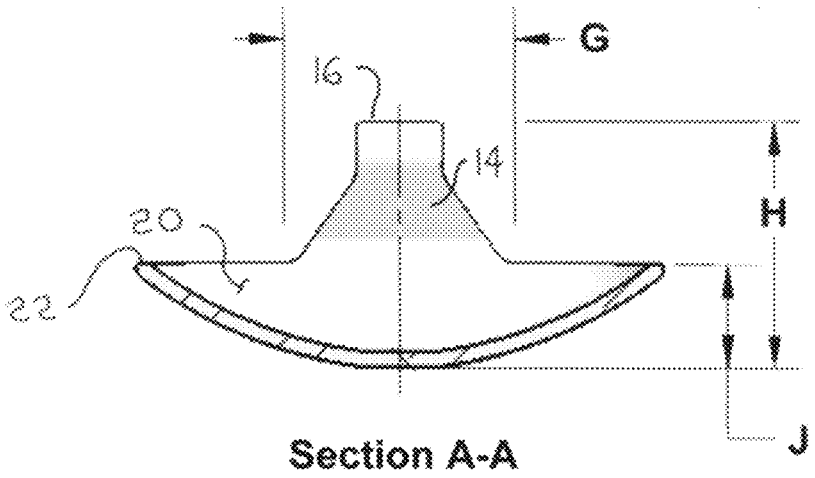
FIG. 7 is a cross sectional view of the beverage garnish holder of FIG. 2 as indicated by the section lines A-A.

FIG. 7 shows a cross-sectional front view of the garnish holder 10, as indicated by the section lines A-A, shown in FIG. 2. In the illustration it can be seen that the width of the transition neck 14 tapers from 'E', the width of the depending tab 16 as shown in FIG. 5, to a width of 'G' where the transition neck 14 meets the concavo-convex cradle 20. In an exemplary embodiment, the dimension 'G' may be about 22 mm. When used for a beverage or cocktail glass, the overall height 'H' of the garnish holder 10 may be about 20 mm to about 35 mm, and nominally, about 23.5 mm. The height of the concavo-convex cradle 20 may be about 7 mm to about 15 mm. The flat planar edge surface 22 can best be seen in this sectional view.

Figure 8:
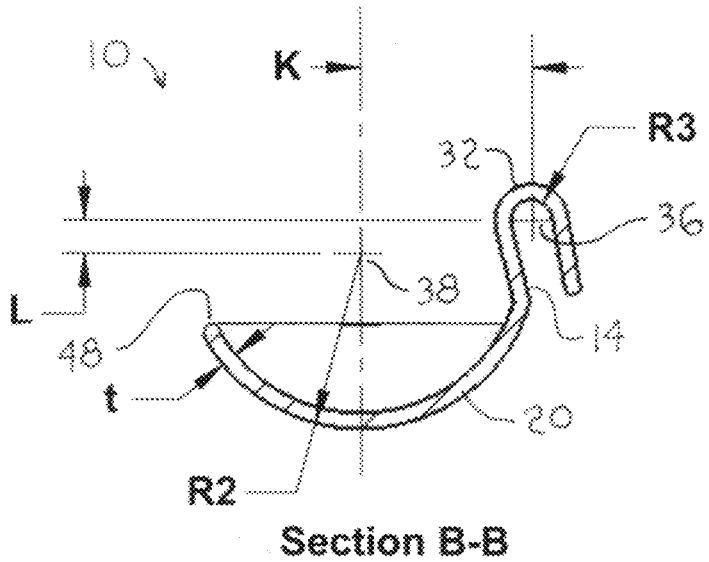
FIG. 8 is a cross sectional view of the beverage garnish holder of FIG. 2 as indicated by the section lines B-B.

FIG. 8 shows a cross-sectional side view of the garnish holder 10, as indicated by the section lines B-B, shown in FIG. 2. In an exemplary embodiment, the rim incurvation 32 has an internal radius 'R3' of about 2.0 mm. The center of curvature 36 for the rim incurvation 32 is laterally offset a distance 'K' from the center of curvature 38 for the 'R2' radius of the concavo-convex cradle 20, and is transversely offset by a dimension from the center of curvature 38. In an exemplary embodiment, the lateral offset 'K' is about 16.2 mm and the transverse offset 'L' is about 3.2 mm, making the length of the transition neck approximately 10 mm. It can be appreciated that, if the garnish holder 10 is to be used for a beer mug with a thicker wall, the dimension R3 can be increased to accommodate the rim of the beer mug. In the particular configuration shown in FIG. 8, the concavo-convex cradle 20 includes an optional rounded surface edge 48 to provide a decorative appearance to the beverage garnish holder 10. The material forming the garnish holder may have a thickness 't' of about 1.5 mm, and may have a rounded edge surface 48 as an alternative to the flat edge surface 22 shown in FIG. 7.

Figure 9:
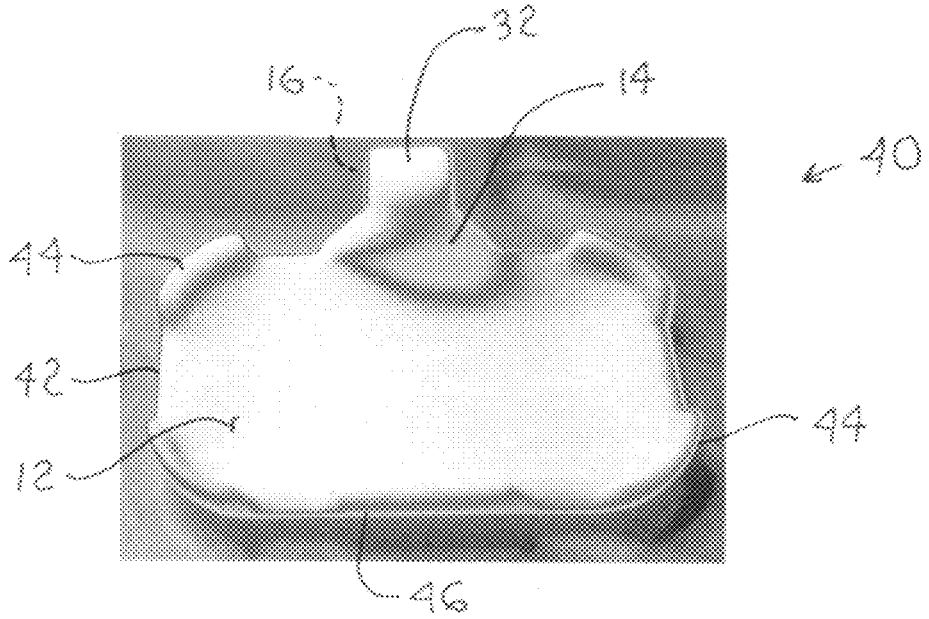
FIG. 9 is an isometric front view of an alternate embodiment of the beverage garnish holder of FIG. 1 providing perimeter tabs.

FIG. 9 shows an alternate embodiment of a garnish holder 40 having the depending tab 16, the transition neck 14, the rim incurvation 32, and the upper surface 12 as described for the beverage garnish holder 10 described above. The beverage garnish holder 40 has a discontinuous perimeter 42 with a perimeter corner tab 44 at each corner of the perimeter 42. A perimeter edge tab 46 may be provided on the perimeter 52 between two edge tabs 46. The edge tabs 46 and the corner tabs 44 may function to prevent a largely spherical garnish from rolling off the upper surface 12. In an exemplary embodiment, the perimeter corner tabs may be approximately 12 mm in length, the perimeter edge tab 46 may be about 15 mm in length, and the tabs 44, 46 may all be about 3 mm in height.

Figure 10:
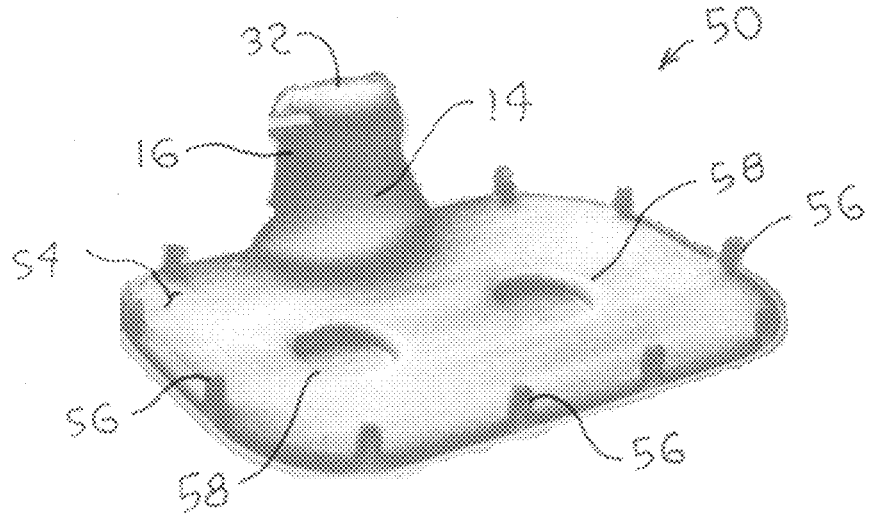
FIG. 10 is an isometric perspective view of an alternate embodiment of the beverage garnish holder of FIG. 1 providing perimeter pegs.

FIG. 10 shows another alternate embodiment of a garnish holder 50 having the depending tab 16, the transition neck 14, and the rim incurvation 32. An upper surface 54 is similar to upper surface 12 as in the garnish holder 10 described above. The garnish holder 50 has a substantially continuous perimeter 52 with a plurality of perimeter pegs 56 spaced along the edges of the perimeter 52 to more positively retain a beverage garnish on the upper surface 54. Two surface dimples 52 may be positioned in the upper surface 54 for placement of a beverage garnish. It should be noted that the surface dimples 52 may not extend through the bispherical cradle 20. In an exemplary embodiment, the perimeter pegs 56 may be approximately 3 mm in height and approximately 2 mm in diameter. The perimeter pegs 56 and surface dimples 58 (i.e., shallow counter-bores) function to prevent a garnish from rolling or sliding off the upper surface 54.

It is to be understood that the description herein is only exemplary of the invention, and is intended to provide an overview for the understanding of the nature and character of the disclosed beverage garnish holder. The accompanying drawings are included to provide a further understanding of various features and embodiments of the method and devices of the invention which, together with their description serve to explain the principles and operation of the invention.

What is claimed is:

1. A beverage garnish holder for suspension from the rim of a beverage glass, said beverage garnish holder comprising:

a rectangular concavo-convex cradle to support a beverage garnish, said concavo-convex cradle comprises an external convex surface with radius of about 45 mm when viewed from a first direction and a second radius of about 17 mm when viewed from a second direction;

wherein said second direction is orthogonal to said first direction;

a rim incurvation configured to engage the beverage glass rim;

a transition neck extending about 10 mm from said rim incurvation to said concavo-convex cradle; and a depending tab having a width of about 8 mm;

wherein the depending tab is configured to extend from said rim incurvation into said beverage glass.

2. The beverage garnish holder of claim 1 wherein said rim incurvation comprises an internal radius of approximately two millimeters.

3. The beverage garnish holder of claim 1 wherein said transition neck comprises an isosceles trapezoid shape.

4. The beverage garnish holder of claim 1 wherein said depending tab is of rectangular shape.

5. The beverage garnish holder of claim 1 further comprising a flat planar edge surface to provide a decorative appearance to said beverage garnish holder.

6. The beverage garnish holder of claim 1 further comprising a rounded surface edge to provide a decorative appearance to said beverage garnish holder.

7. The beverage garnish holder of claim 1 further comprising an overall height of from about twenty millimeters to about thirty five millimeters.

8. The beverage garnish holder of claim 1 wherein said concavo-convex cradle comprises a substantially rectangular cradle rim, said rectangular cradle rim having a length of about 50 mm and a width of about 30 mm.

9. The beverage garnish holder of claim 1 further comprising a cradle opening that extends through said concavo-convex cradle.

10. The beverage garnish holder of claim 1 further comprising at least one surface dimple disposed in said bispherical cradle.

11. The beverage garnish holder of claim 1 wherein said bispherical cradle comprises a height of from five millimeters to fifteen millimeters.

12. The beverage garnish holder of claim 11 further comprising at least one perimeter tab extending from said cradle rim.

13. The beverage garnish holder of claim 11 further comprising at least one perimeter peg extending from said cradle rim.

* * * * *